US007236144B2

(12) United States Patent
Ari

(10) Patent No.: US 7,236,144 B2
(45) Date of Patent: Jun. 26, 2007

(54) METHOD FOR PROJECTING SIGNS ON PRINTED MATTER AND MEANS FOR THE SAME

(75) Inventor: Amichai Ben Ari, Neve Daniel (IL)

(73) Assignee: David Shriki, M.P. Lev Shomeron (IL)

( * ) Notice: Subject to any disclaimer, the term of this patent is extended or adjusted under 35 U.S.C. 154(b) by 569 days.

(21) Appl. No.: 10/749,568

(22) Filed: Jan. 2, 2004

(65) Prior Publication Data

US 2004/0257301 A1 Dec. 23, 2004

(30) Foreign Application Priority Data

Jan. 2, 2003 (IL) ..... 153783

(51) Int. Cl.
*G09G 5/00* (2006.01)

(52) U.S. Cl. ..... 345/9; 345/2.1

(58) Field of Classification Search ..... 345/9, 345/173–179; 178/18.01, 18.04, 19.01, 19.02; 364/148; 156/250; 273/272; 348/239; 700/28; 355/27

See application file for complete search history.

(56) References Cited

U.S. PATENT DOCUMENTS

| | | | | |
|---|---|---|---|---|
| 4,384,408 A * | 5/1983 | Bohlayer | ..... | 33/270 |
| 5,764,508 A * | 6/1998 | Harper et al. | ..... | 700/28 |
| 6,581,869 B2 * | 6/2003 | Arrane | ..... | 242/538.2 |
| 6,798,403 B2 * | 9/2004 | Kitada et al. | ..... | 345/173 |

* cited by examiner

*Primary Examiner*—Nitin I. Patel
(74) *Attorney, Agent, or Firm*—Lowe, Hauptman & Berner LLP

(57) ABSTRACT

The invention provides a method and means for projecting signs onto printed matter, without physically changing the printed matter. The method is especially useful for projecting signs on holy scripts such as the Torah, for aid of its reading.

6 Claims, 7 Drawing Sheets

A

B

METHOD FOR PROJECTING SIGNS ON PRINTED MATTER AND MEANS FOR THE SAME

FIELD OF THE INVENTION

The present invention generally relates to a method for aiding the reading of printed matter.

BACKGROUND OF THE INVENTION

The Jewish torah scroll is written in biblical Hebrew. For thousands of years, the bible has been copied by experts, without changing anything in the text or in its appearance, e.g., keeping the stiff roles of the fonts size and type etc. The bible text is read three times a weeks, and on holidays. This ancient text is hard to read to those that are not skilled in the art, known by the Hebrew term baaley qria. Various symbols were added over the years to didactic biblical texts, some of them are the cantillation marks which are diacritic symbols annotating the text for the purpose of cantillation. Those marks are also known in Hebrew by the term 'ta'amey hamiqra' and used to indicate how a text is to be chanted or sung. The cantillation marks are adapted to have interpretative means how to read the word, how to understand the sentence, how to sing or chant the phrase and to provide an absolute unity in reading the bible text, so that non-traditional reading of the text is unaccepted. The biblical text is also poor in vowel and punctuation marks, thus requiring an acknowledged amount of experience in the text in order to read it and to understand it properly Because no writing is allowed on the holly scroll, every student reading the text today is obligated to memorized the chant of reading the text by heart, by repeating along with either his Rabbi or by repeating a recording of a baaley qria numerous times.

As the years pass, less and less people are trained and skilled in the art of reading the torah in the traditional orthodox manner. Thus, only few such baaley qria are available to serve the community. Additionally, the daily time-table of the modem life does not provide sufficient time for those who know to read the bible text, to prepare the reading, so the quality, unity and thus the current availability of said reading is significantly reduced. A simple, convenient and reliable way for reading the torah, especially in a manner acceptable by Jewish orthodox Rabbis, is thus strongly desired.

SUMMARY OF THE INVENTION

It is thus the main goal of the present invention to provide a useful method for projecting signs on top of a printed matter in order to help the reading of said printed matter without altering the original text. Said method comprising the steps of providing said printed matter in a manner suitable for said projection. Then, said signs are prepared on a suitable media in the manner so that said signs are in alignment with said printed matter. Lastly, said signs are projected on top of said printed matter such that said signs are superimposed on the printed matter in a predetermined manner.

The first step of the method of the invention is the provision of the printed matter in a suitable form for projection. Typically the printed matter should be correctly aligned with the suitable media comprising the signs to be projected on top of the printed matter.

The media should be such that it can be projected on the printed matter in a manner that the signs are superimposed on the printed matter in a correct orientation, so one reading the printed matter views the superimposed signs incorporated with the printed matter as one integral, easily read text.

By one option, the signs are present on a transparent sheet that is physically placed on the printed matter, in accordance with suitable alignment positioning clues so that the signs are read with the text on which they are superimposed.

By another option, the suitable media is a visual -projection of characters carried out with the aid of a suitable projector wherein the page on which the text is printed, serves as the screen. The projector may be connected to a slide projector, a computer or any other suitable device capable of transmitting the signs.

It is in the scope of the present invention wherein the printed matter is a traditional torah scroll written by hand and further wherein the projected signs are cantillation marks. Moreover, those signs are preferably selected from cantillation marks (i.e., in Hebrew: Teamey Mikra), vowel marks, punctuation marks, and/or musical notes. It is also in the scope of the present invention wherein the said signs are means for editing the printed matter to be more readable. Similarly, those signs are preferably selected from page number, header and/or footer, symbols, graphical signs, references and links, proofreading signs, the last word of previous page, the first word of coming page and/or the queue for reading the torah (i.e., in Hebrew: aliya latorah). Alternatively or additionally, aforementioned signs are selected from Braille notes, text printed in various languages, colors, sizes and fonts, pictures and/or drawn animations. It is acknowledged that a plurality of insertion layers is to be projected or superimposed on top of the printed manner.

It is also in the scope of the present invention to provide a useful method, especially adapted for computerized projecting of signs on top of printed matter. The aim of the method is to prepare a set of signs for projection on a printed matter, such that each sign will be projected in appropriate position respective to a character, or respective to a group of characters of the printed mater. According to one preferred embodiment said method comprising the following seven steps: (i) scanning the printed matter such in a way the text is restored in a file. (ii) obtaining or creating a database comprising a list of sign to be incorporated into the said text. (iii) retrieving a character or a plurality of characters from the said text file. (iv) A sign or a plurality of signs is retrieved from the said database. (v) Said conjugated character-sign couple is compared with a reference character-sign couple. (vi) Said conjugated couple is fitted or not fitted in a loop such in the way that all the text is projected by the coordinated signs. Lastly, in step (vii) the enriched text is projected by the coordinated signs.

According to the present invention the method for computerized projection of signs may vary according to the actual printed matter and according with the actual signs that should be projected. For example, when dealing with a homogeneous text (namely a text comprising a set of characters each of which has predetermined dimensions and a predetermined shape in any of its repetitions along the text) the method could make use of the predetermined dimensions data for calculating the position of each sign to be projected, for obtaining the desired correlation between a character (or a group of characters) and a corresponding sign or a group of signs. When dealing with a non homogeneous text, such as a hand written text of the Torah wherein each character may vary in an extreme manner, either in its dimensions and in its shape, along its different repetitions in the text, the calculation of the appropriate positioning of the signs (in this case the Biblical cantillation marks) may not relay on general predetermined dimension and shape characteristics, but should be prepared as a tailor made, especially adapted to the text of the actual physical Torah scroll for which the media for projection is being prepared.

According to one preferred embodiment the determination and allocation of an appropriate position for each sign in the media to be projected, is made in real time, i.e. during the scanning of the text and upon optical character recognition (OCR) of the characters, wherein at the moment of recognition of a character its exact X-Y coordination on the scanned sheet is known to the computer means dealing with the scanning and the recognition, thus could be used for determining and allocating an appropriate respective position to a corresponding sign, on the media being prepared for projection.

According to another embodiment the positioning of the signs (e.g. cantillation marks) in the media being prepared for projection, is not made in real time, i.e. during the OCR. According to this embodiment, the computer stores the X-Y coordination of each of the scanned characters (and according to other variations of the method, of each word or group of characters), and a computer program calculates the position of the signs (or cantillation marks) and deals with preparing the media to be projected, after the completion of the scanning of the text. It is still in the scope of the present invention to present a transparent polymeric sheet member adapted to be placed in a superimposed manner on top of a printed matter in the method defined in any of the above so that the signs are aligned and incorporated properly with the printed text. Said sheet may be a composition of a plurality of stripes, projecting said signs mostly the line of the text and not the spaces between lines. According to one preferred embodiment of this invention, the transparent sheet could be printed with signs for projection, directly from a computer having appropriate program for preparing such media according to the method of computerized projection, and through a conventional laser printer. According to other preferred embodiments the signs are printed on the transparent sheet according to the computerized projection data, in any acceptable printing or photographing way.

Lastly, it is also an aim for the present invention to present a scrolling device useful for coordinate the projecting sheet member on the printed matter so signs are projected on top of the printed matter in alignment (coordinated) with the text. Said device preferably comprising a first roll and a second roll, wherein a long projecting sheet member is accommodate in between, and further wherein at least one of said rolls is having means to roll the sheet so each of the pages of the printed matter is fitting a known portion of the signs.

BRIEF DESCRIPTION OF THE DRAWINGS

In order to understand the invention and to see how it may be carried out in practice, some preferred embodiments will now be described, by way of non-limiting examples only, with reference to the accompanying drawings, in which.

DETAILED DESCRIPTION OF THE INVENTION

The following description is provided, along all chapters of the present invention, so as to enable any person skilled in the art to make use of said invention and sets forth the best modes contemplated by the inventor of carrying out this invention. Various modifications, however, will remain apparent to those skilled in the art, since the generic principles of the present invention have been defined specifically to provide the method for projecting insertion on printed matter The present invention generally relates to a method for projecting signs on a printed matter. Said printed matter is generally selected from any book, handbook, textbook, reference book, encyclopedia, notebook and especially any pedagogic written media. In the core of the present invention, said printed matter is a traditional Jewish torah scroll (i.e., in Hebrew: Safer Torah), wherein the text of the bible is written by the hand of an expert (i.e., in Hebrew: Safer Stem).

In the following the term "projecting" is meant to encompass both projection of a visual signal in the form of a sign on a text, in a manner similar to projection of visual signs on a screen as well as to the physical superposition of a transparent film bearing the signs on the printed matter so that in appearance the signs are superimposed on the text.

More specifically, the present invention relates to a method to project signs such as cantillation, vowel and punctuation marks on an original text. Said text is usually written by hand, such as the traditional Jewish bible scrolls, musical notes etc., and therefore it is essential that the original is not altered by adding to the text anything else. In addition, those inserts are selected from various editing notes. Said notes are selected, yet not limited to a page number, references and links, proofreading, header and footer etc. More over, those insertion been projected on top of the text may be selected from Braille notes, symbols, graphical signs and/or pictures. In particularly, said inserts may be also selected from any musical notations, such as clefs, scales, notes, harmony and/or chord indications etc.

Figure 1:
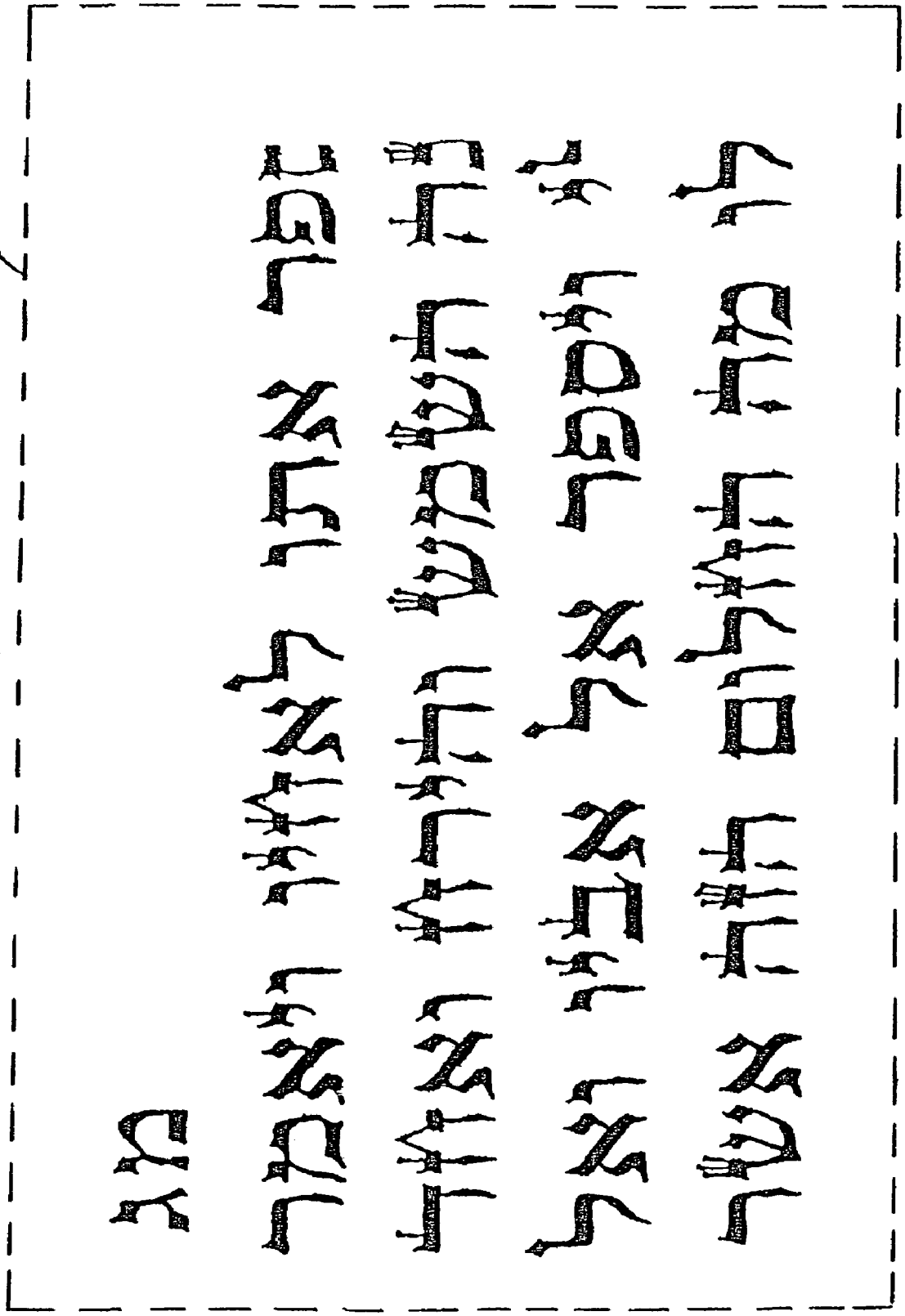
FIG. 1 presents a copy 100 of a part of a Jewish torah scroll comprising no punctuation marks.
Figure 2:
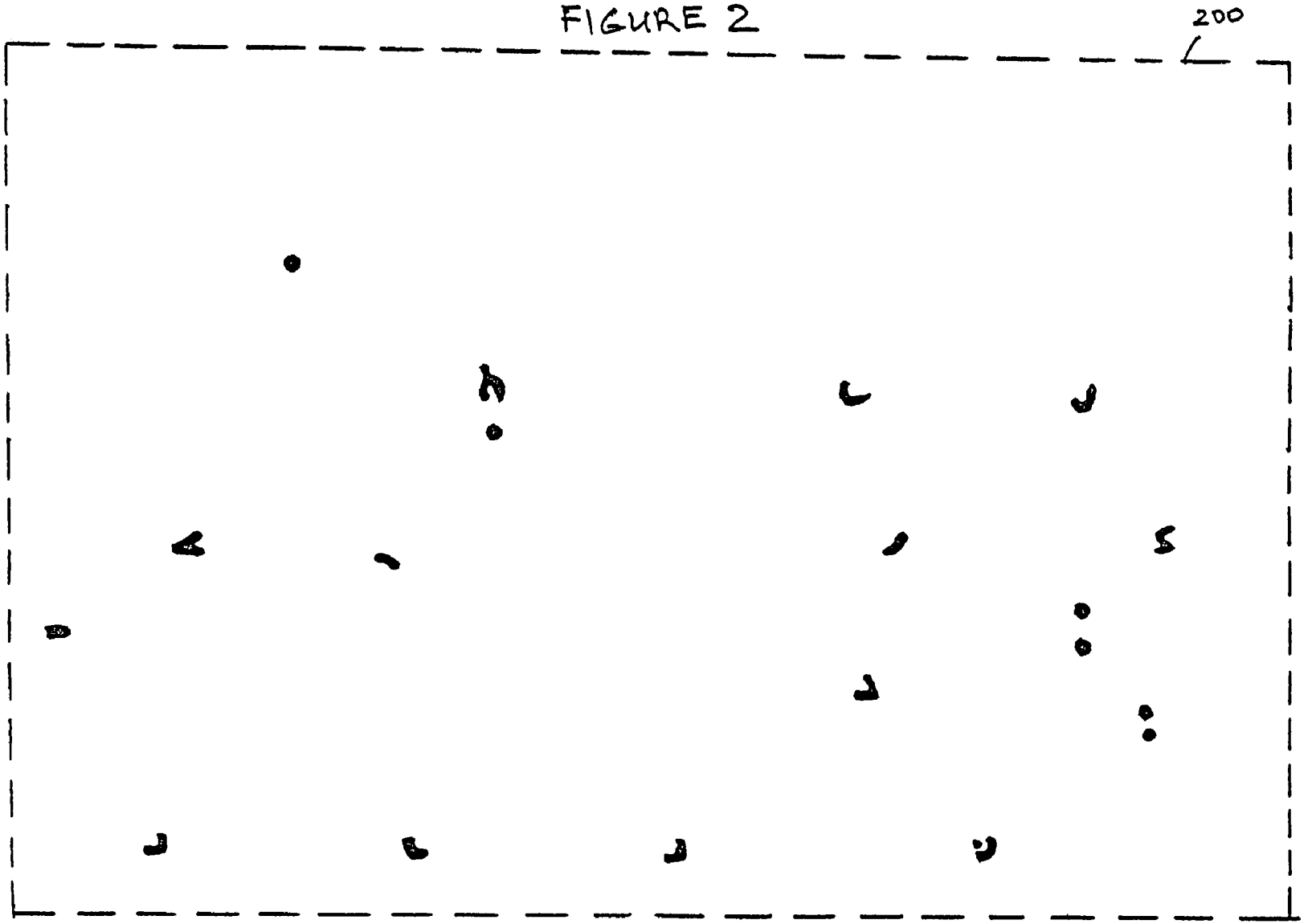
FIG. 2 presents a transparent sheet 200 comprising cantillation marks coordinated with said torah text.
Figure 3:
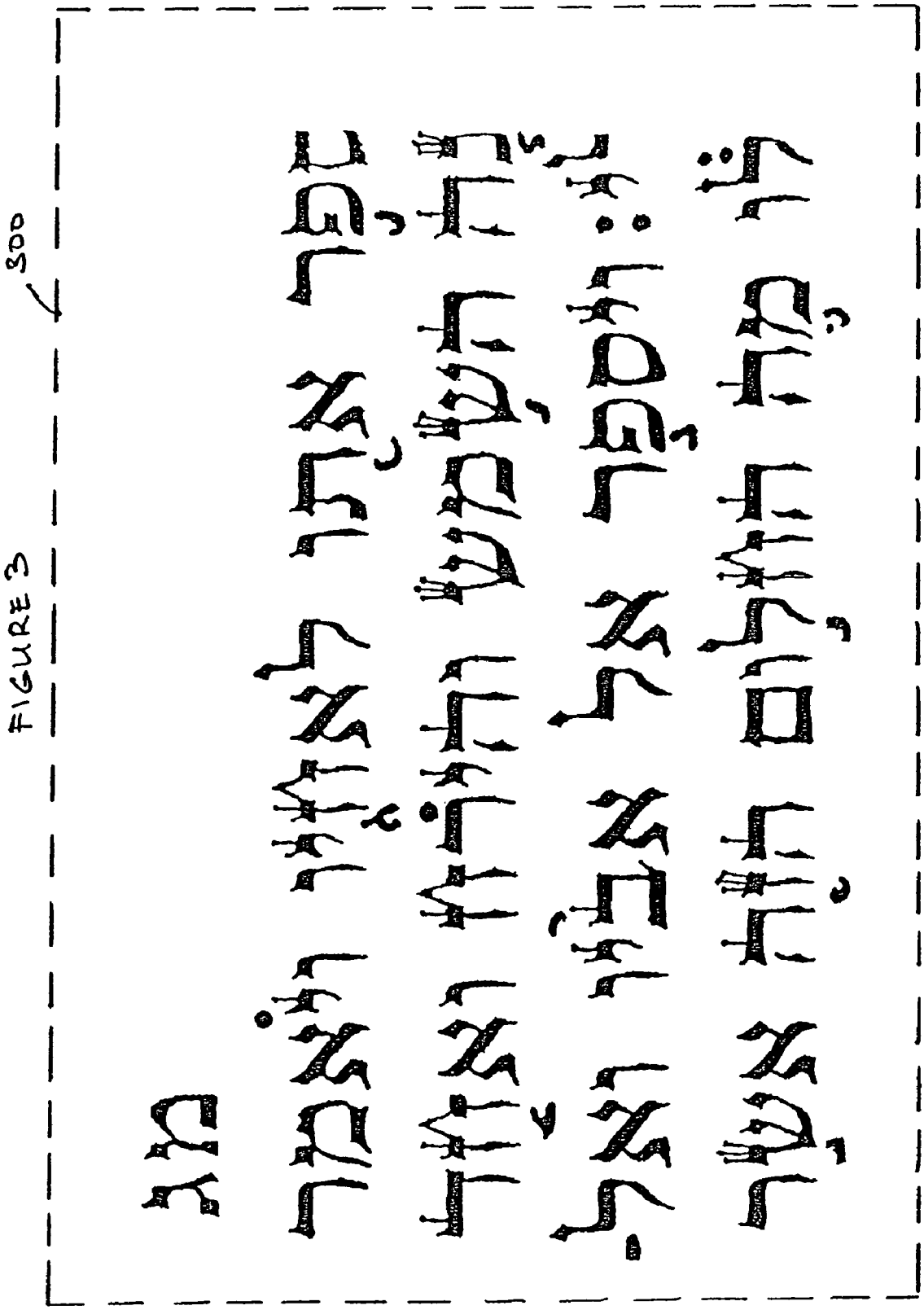
FIG. 3 presents a projected view 300 of the torah text comprising the cantillation marks.

Reference is made now to FIG. 1, presenting a copy of a part of a Jewish torah scroll having neither punctuation, cantillation nor vowel marks. FIG. 2 presents a transparent sheet comprising cantillation marks coordinated with said torah text. FIG. 3 presents a projected view of the torah text comprising the cantillation marks.

As set forth, it is in the scope of the present invention to provide a useful method to project aforementioned inserts on top of a torah book. As one can see in FIGS. 1–3, each page of said scroll comprises 48 to 60 lines in a page and 35 to 55 characters in one line, a transparent sheet adapted for overhead projector is mostly suitable. A polyethylene terphthalate made sheet is suitable for this instance. For various instances, a laminated film as such as polyester is suitable. Alternatively, a strip of self-adherent polymer is to be used.

Said polymeric sheet may be adapted for a singular use or alternatively, said sheet may be adapted for a continuous use.

Figure 4:
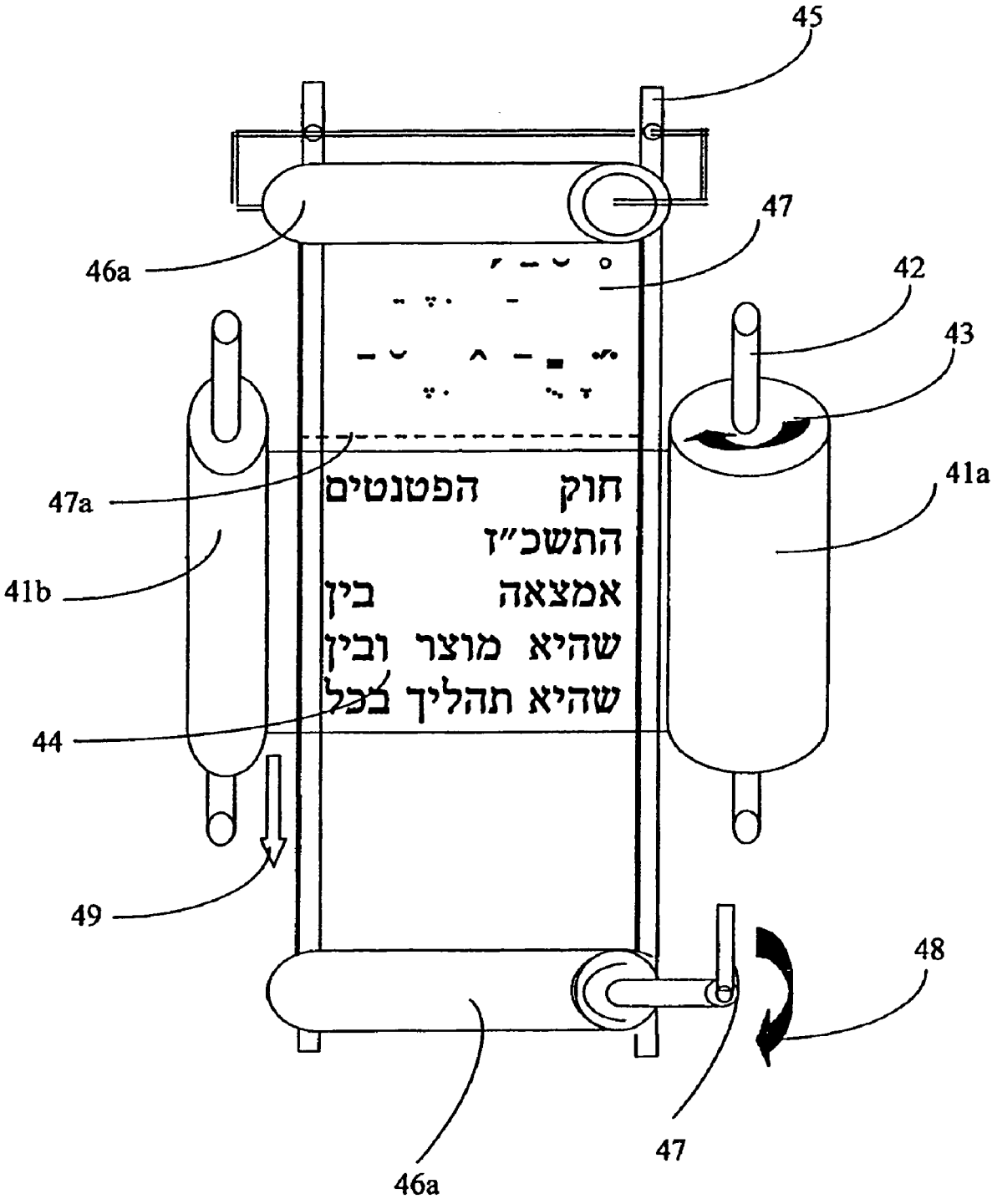
FIG. 4 schematically presenting a scrolling device on first page, without projection of signs.

Such a continuous use is provided by means of a fixed or mobile rolling device. The said roll is adapted to use an elongated polymeric sheet, accommodated in a suitable cartridge. Reference is thus made now to FIG. 4 schematically presenting a traditionally handmade bible scroll comprising a first roll (41*a*) and a second roll (41*b*). Said rolls are operated by means of set of handles (such as 42) in the direction (43). The biblical text (44) is delivered from the first roll to the second one.

A mobile rolling device as defined above is located adjacent to the said bible scroll. Said device comprises of a frame (45) located under the biblical text. A transparent long sheet (47) is delivered from a first roll (46*a*) towards a second roll (46*b*) be means of handle (47), rotated in a 360° movement in the direction (48) so the transparent sheet is moving downwards (49). To align the insertion printed on sheet (47) with the biblical text (44) is easily provided by means dashed line (47*a*) indicating the proper place of the sheet on top of the text.

Figure 5:
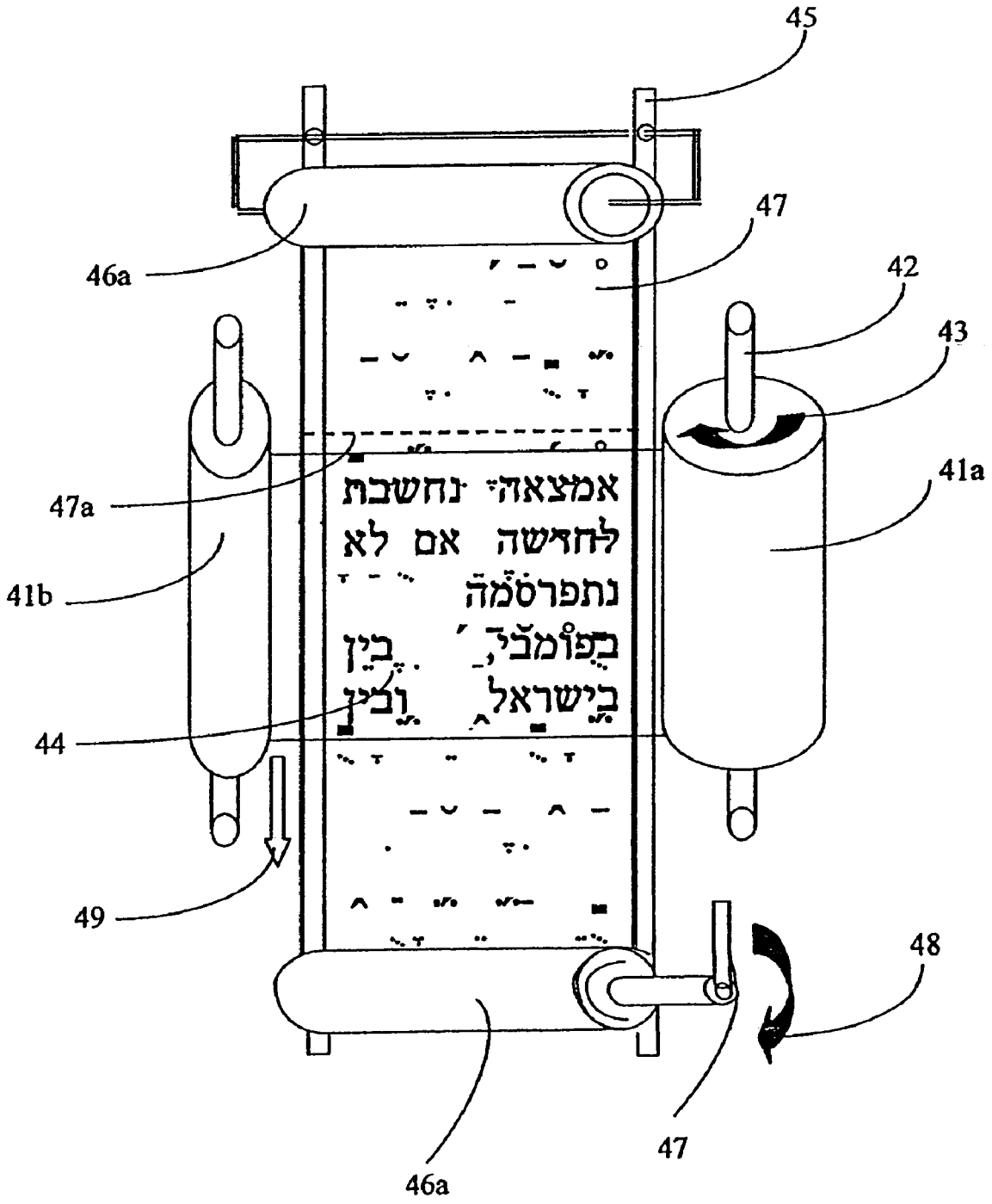
FIG. 5 schematically presenting the said scrolling device on second page, after the projection of signs.

Subsequently, reference is made now to FIG. 5, presenting the very same roller, whereat the text was rolled to a certain page, and further wherein the cantillation marks are projected on top of the text of the said page.

Figure 6:
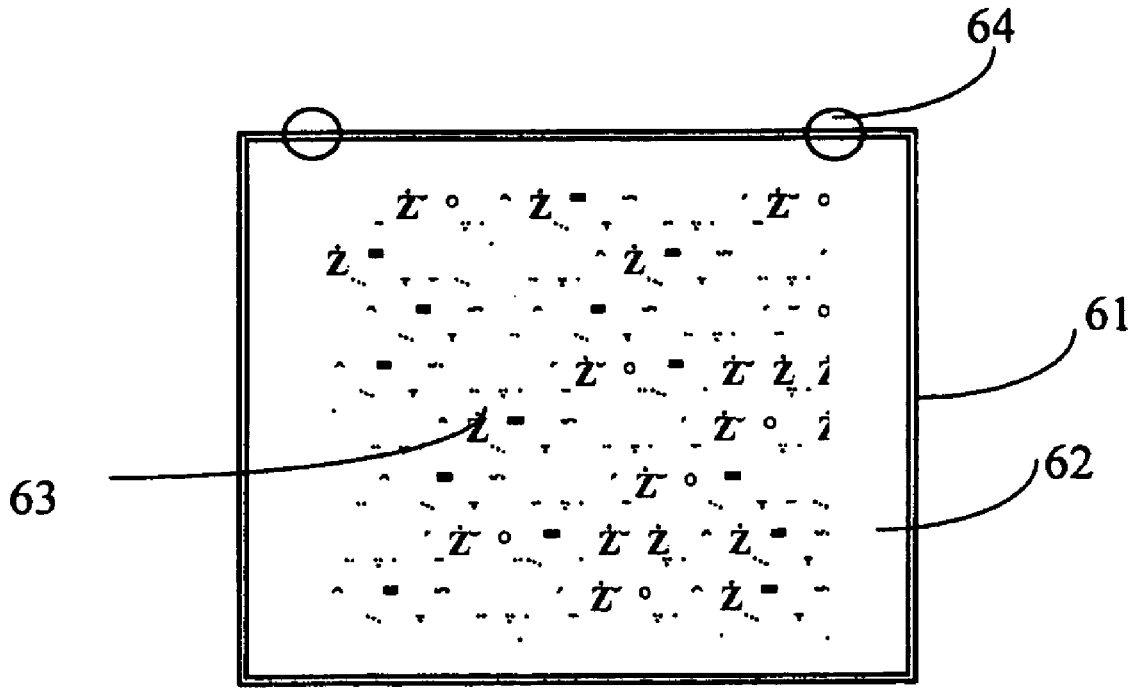
FIG. 6A schematically presenting one transparent sheet accommodated in a frame and FIG. 6B schematically presenting an array of multiple transparent sheets accommodated in a pager.
Figure 6:
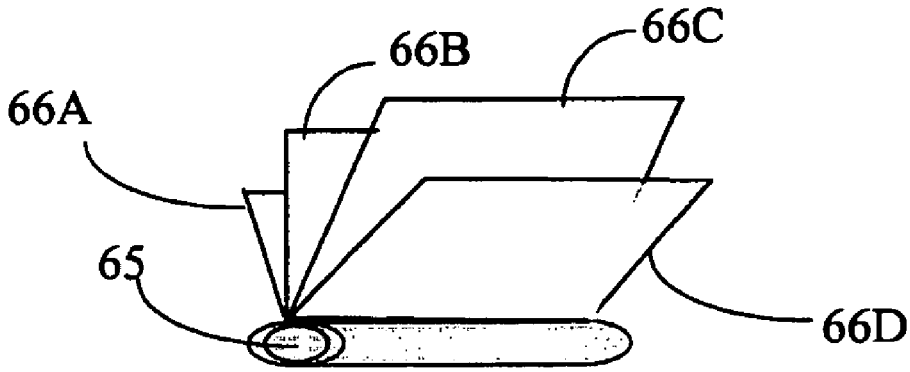

Reference is now made to FIG. 6A schematically presenting a device adapted to project cantillation marks or any other signs as defined in the present invention, said device comprises of a relatively rigid frame (61) accommodating a transparent sheet (62) whereat said cantillation and/or signs are written or printed (63). According to one embodiments of the present invention, anchoring devices are appended to said frame so that device is suitable to be appended upon the printed matter at any position. Said embodiment is especially useful to be used in that torah scroll that is to be open to be read in a perpendicular orientation.

Reference is still made to FIG. 6B schematically presenting a pager having note-pad characteristics. In this embodiment of the present invention, a plurality of transparent sheets (66A–D) are clasped or held in one of their rims by a mutual holder (65). Each of said sheets contains signs or cantillation to be projected over a subsequent page of the printed matter and/or torah scroll.

Figure 7:
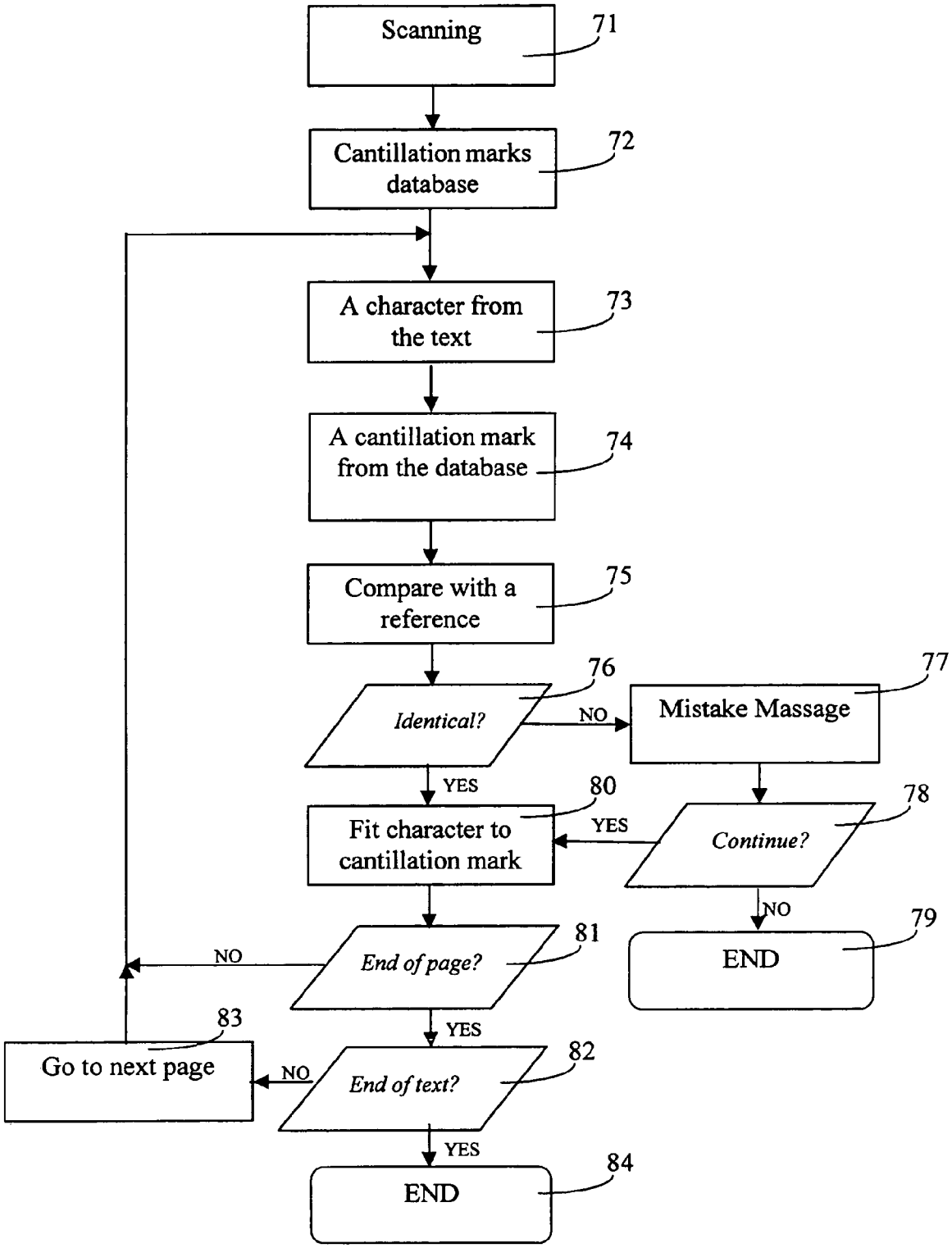
FIG. 7 schematically presenting a block diagram of a program adapted to project cantillation marks on traditionally written bible texts.

Reference is lastly made to FIG. 7 schematically presenting a simplified block diagram of the method for projecting signs, as such as cantillation marks on top of a printed matter, as such as a traditional handmade biblical scroll. Said printed matter may be already scanned or it is scanned (71) to a file. It is acknowledged that in many cases, expensive biblical scrolls are scanned in order to identify them in case of theft and additionally or alternatively, said scrolls are scanned to detect mistakes in the written text. Subsequently or in parallel, said cantillation marks of the original text is restored in a cantillation database (72). A character, a word or any suitable phrase of the original text (73) and a cantillation mark or a plurality of such marks (74) correlated to said characters are provided and subsequently compared (75) with a reference file comprising a character and its conjugated mark. The identity of the couple is now tested (76). In case the mark is not fitting the character, a mistake announcement is to be presented (77). If the user is allowing the correlation, the very same overlapping is provided (78). If the user does not allow the correlation, the process is stopped (79). The character is to be fitted with the cantillation mark or with any other sign as defined above (80). At the end of the page (81) of the original text the loop is continue until the end of the text (82) or the next page is been processed (83).

It is further in the scope of the present invention wherein the aforementioned scanning step (71) may be verified by other know techniques, such as photocopying the printed matter by any suitable means and processing said text by an OCR program so a text file is obtained, and so that X-Y coordination of the characters are registered for calculating the positioning of the signs for preparing a media for projection.

According to another preferred embodiment, the method for computerized projection of signs on a printed matter comprising; (a) scanning a sheet printed with characters each of which is having a predetermined X-Y coordination defining its location on the sheet; (b) recognizing the characters by means of appropriate computer program; (c) registering the X-Y coordination of each character or of predetermined groups of characters; (d) matching appropriate sign or signs for each character (or group of characters); (e) determining for each sign or for each group of signs appropriate X-Y coordination respective to the corresponding character (or characters) (f) preparing a media of signs for projection on a corresponding sheet of printed characters.

According to one preferred embodiment of the present invention the matching of appropriate signs to corresponding characters is made by a computer algorithm which calculates what sign is appropriate to the recognized character or to the group of recognized characters (the algorithm may use arbitrary rules, such as "match the sign '%' if the character is a number"). According to another preferred embodiment, the matching of appropriate signs to corresponding characters is made by a computer algorithm which verifies each character versus similar character existing in a predetermined comparison file with which the scanned file is believed to be exactly correspond, wherein at least a part of the characters of the comparison file are linked to corresponding signs, and wherein upon verification of a character in the scanned file as matching a versus character in the comparison file, a sign that is linked to the character in the comparison file is being copied to a new file that contains signs to be projected, wherein the signs are coordinated in a predetermined manner respective to the X-Y coordination of a corresponding scanned character.

The invention claimed is:

1. A computer-implemented method for generating a transparent sheet bearing signs in proper spatial alignment with text in a printed matter, the method comprising the following steps:

a. scanning the printed matter such in a way the text is restored in a file;

b. obtaining a database comprising a list of signs to be incorporated into the said text;

c. retrieving a character or a plurality of characters from the said text file;

d. retrieving a sign or a plurality of signs from the said database;

e. creating a conjugated character-signal couple from each of said character and each of said signs f. comparing said conjugated character-sign couple with a reference character-sign couple;

g. fitting said conjugated couple such in the way that all the text is aligned with signs, optionally said fitting is by a feed-back loop;

h. presenting the printed text with the aligned signs.

2. The method according to claim 1, wherein the scanning step (a) is replaced by the steps comprising;

a. photocopying and or scanning the printed matter so a file comprising said copied or scanned text is obtained;

b. translating the said file text by means of an OCR program so a text file is obtained.

3. A computer-implemented method for generating a transparent sheet bearing signs in proper spatial alignment with text in a printed matter, the method comprising:

(a) generating a file containing data representative of text in the printed matter;

(b) obtaining a database comprising a list of signs to be superimposed on to said text in proper spatial alignment with respect thereto;

(c) for each character in the text having one or more signs associated therewith:

(i) creating a conjugated character-sign couple from the respective character and associated one or more signs;

(ii) obtaining a reference character-sign couple corresponding to said conjugated character-sign couple;

(iii) determining a spatial alignment of each of the associated signs in the conjugated character-sign couple relative to the character in the conjugated character-sign couple so as to match a relative spatial alignment of character and signs in the corresponding reference character-sign couple; and (iv) visibly rendering each of the associated signs of the conjugated character-sign couple on the transparent sheet according to said spatial alignment.

4. The method according to claim 3, wherein generating a file containing data representative of text in the printed matter comprises scanning the printed matter.

5. The method according to claim 3, wherein generating a file containing data representative of text in the printed matter comprises:

(a) photocopying and or scanning the printed matter to obtain a file comprising copied or scanned text; and (b) translating said copied or scanned text by means of an OCR program to obtain a text file.

6. A computer-implemented program storage device readable by machine, tangibly embodying a program of instructions executable by the machine to perform a method for generating a transparent sheet bearing signs in proper spatial alignment with text in a printed matter, the method comprising:

(a) generating a file containing data representative of text in the printed matter;

(b) obtaining a database comprising a list of signs to be superimposed on to said text in proper spatial alignment with respect thereto;

(c) for each character in the text having one or more signs associated therewith:

(i) creating a conjugated character-sign couple from the respective character and associated one or more signs;

(ii) obtaining a reference character-sign couple corresponding to said conjugated character-sign couple;

(iii) determining a spatial alignment of each of the associated signs in the conjugated character-sign couple relative to the character in the conjugated character-sign couple so as to match a relative spatial alignment of character and signs in the corresponding reference character-sign couple; and (iv) visibly rendering each of the associated signs of the conjugated character-sign couple on the transparent sheet according to said spatial alignment.

* * * * *

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 1, Line 12:

Change "The Jewish torah scroll is written in biblical Hebrew. For" to --The Jewish Torah scroll is written in Hebrew. For--.

Column 1, Line 19:

Change "were added over the years to didactic biblical texts, some of" to --were added over the years to didactic biblical texts,--.

Column 1, Line 20:

Change "them are the cantillation marks which are diacrtic symbols" to --including cantillation marks which are diacrtic symbols--.

Column 1, Line 29:

Change "also poor in vowel and punctuation marks, thus requiring an" to --also lacking in vowel and punctuation marks, thus requiring an--.

Column 1, Line 33:

Change "today is obligated to memorized the chant of reading the text" to --today is obligated to memorize the chant of reading the text--.

Column 1, Line 36:

Change "As the years pass, less and less people are trained and" to --As the years pass, fewer and fewer people are trained and--.

Column 1, Line 53:

Change "without altering the original text. Said method comprising" to --without altering the original text. Such a method--.

Column 1, Line 54:

Change "the steps of providing said printed matter in a manner" to --comprises providing said printed matter in a manner--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 1, Line 55:

Change "suitable for said projection. Then, said signs are prepared on" to --suitable for projection. Then, the signs are prepared on--.

Column 1, Line 56:

Change "a suitable media in the manner so that said signs are in" to --a suitable medium in a manner that the signs are in--.

Column 1, Line 57:

Change "alignment with said printed matter. Lastly, said signs are" to --proper alignment with the printed matter. Lastly, the signs are--.

Column 1, Line 58:

Change "projected on top of said printed matter such that the signs" to --projected on top of the printed matter such that the signs--.

Column 1, Line 64:

Change "aligned with the suitable media comprising the signs to be" to --aligned with the suitable medium comprising the signs to be--.

Column 1, Line 66:

Change "The media should be such that it can be projected on the" to --The medium should be such that it can be projected on the--.

Column 2, Line 8:

Change "By another option, the suitable media is a visual-projec-[tion]" to --By another option, the medium is a visual-projec-[tion]--.

Column 2, Lines 20-21:

Change "the scope of the present invention wherein the said signs are means for editing the printed matter to be more readable." to --the scope of the present invention wherein the signs serve to render the printed matter to be more readable.--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 2, Line 25:

Change "previous page, the first word of coming page and/or the" to --a previous page, the first word of a coming page and/or the--.

Column 2, Line 26:

Change "queue for reading the tora (i.e., in Hebrew: aliya latorah)." to --cue for reading the torah (i.e., in Hebrew: aliya latorah).--.

Column 2, Line 42:

Change "is restored in a file, (ii) obtaining or creating a database" to --is restored in a file; (ii) obtaining or creating a database--.

Column 2, Line 43:

Change "comprising a list of sign to be incorporated into the said." to --comprising a list of signs to be incorporated into the said text;--.

Column 2, Line 45:

Change "the said text file. (iv) A sign or a plurality of signs is retrived" to --the text file; (iv) retrieving a sign or a plurality of signs--.

Column 2, Line 46:

Change "from the said database. (v) Said conjugated character-sign" to --from the database; (v) comparing a conjugated character-sign--.

Column 2, Line 47:

Change "couple is compared with a reference character-sign couple." to --couople with a reference character-sign couple;--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 2, Lines 48-51:

Change "(vi) Said conjugated couple is fitted or not fitted in a loop such in the way that all the text is projected by the coordinated signs. Lastly, in step (vii) the enriched text is projected by the coordinated signs." to --spatially disposing the sign in the conjugated couple relative to the character in the conjugated couple so as to match a spatial alignment of the sign and character in the reference character-sign couple; and (vii) protecting the coordinated signs on to the test so as to produce an enriched text.--

Column 3, Line 1:

Change "case the Biblical cantillation marks) may not relay on" to --case the Biblical cantillation marks) may not rely on--.

Column 3, Line 3:

Change "but should be prepared as a tailor made, especially adapted" to --but should be tailor made, especially adapted--.

Column 3, Line 5:

Change "media for projection is being prepared." to --medium for projection is being prepared--.

Column 3, Line 15:

Change "[posi]tion to a corresponding sign, on the media being prepared for" to --[posi]tion to a corresponding sign, on the medium being prepared for--.

Column 3, Line 19:

Change "signs (e.g. cantillation marks) in the media being prepared" to --signs (e.g. cantillation marks) in the medium being prepared--.

Column 3, Line 27:

Change "the scanning of the text. It is still in the scope of the present" to --the scanning of the text. [New paragraph] It is still in the scope of the present--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 3, Line 32:

Change "printed text. Said sheet may be a composition of a plurality" to --printed text. Such a sheet may be a composition of a plurality--.

Column 3, Lines 47-52:

Change "text. Said device preferable comprising a first roll and a" to --text. Such a device preferably comprises a first roller and a--.

Column 3, Line 48:

Change "second roll, wherein a long projecting sheet member is" to --second roller, wherein a long projecting sheet member is--.

Column 3, Line 49:

Change "accommodate in between, and further wherein at least one of" to --accommodated in between the rollers, and further wherein at least one of--.

Column 3, Line 50:

Change "said rolls is having means to roll the sheet so each of the" to --the rollers has means to roll the sheet so each of the--.

Column 3, Line 51:

Change "pages of the printed matter is fitting a known portion of the" to --pages of the printed matter fits a known portion of the--.

Column 4, Line 14:

Change "The following description is provided, along all chapters" to --The following description is provided,--.

Column 4, Line 15:

Change "of the present invention, so as to enable any person skilled" to --so as to enable any person skilled--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 4, Line 16:

Change “in the art to make use of said invention and sets forth the best” to --in the art to make use of the invention and sets for the best--.

Column 4, Line 23:

Change “for projecting signs on a printed matter. Said printed matter” to --for projecting signs on a printed matter. Such printed matter--.

Column 4, Line 27:

Change “[inven-]tion, said printed matter is a traditional Jewish torah scroll” to --[inven-]tion, said printed matter is a traditional Jewish Torah scroll--.

Column 4, Line 29:

Change “is written by the hand of an expert (i.e., in Hebrew: Safer” to --is written by hand of an expert (i.e., in Hebrew: Sofer--.

Column 4, Line 39:

Change “punctuation marks on an original text. Said text is usually” to --punctuation marks on an original text. Such text may be--.

Column 4, Line 44:

Change “notes. Said notes are selected, yet not limited to a page” to --notes. Such notes are selected, yet not limited to a page--.

Column 4, Line 48:

Change “graphical signs and/or pictures. In particularly, said inserts” to --graphical signs and/or pictures. In particular, the inserts--.

Column 4, Line 52:

Change “part of a Jewish torah scroll having neither punctuation” to --part of a Jewish Torah scroll having neither punctuation--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 4, Line 55:

Change "torah text. FIG 3 presents a projected view of the Torah text" to --torah text. FIG. 3 presents a projected view of the Torah text--.

Column 4, Line 59:

Change "top of a torah book. As one can see in FIGS. 1-3, each page" to --top of a Torah scroll. As one can see in FIGS. 1-3, each page--.

Column 4, Line 60:

Change "of said scroll companies 48 to 60 lines in a page and 35 to" to --of the scroll companies 48 to 60 lines in a page and 35 to--.

Column 4, Line 61:

Change "55 characters in one line, a transparent sheet adapted for" to --55 characters in one line. A transparent sheet adapted for--.

Column 4, Line 63:

Change "phthalate made sheet is suitable for this instance. For various" to --phthalate sheet is suitable for this instance. For various--.

Column 4, Line 65:

Change "Alternatively, a strip of self-adherent polymer is to be used." to --Alternatively, a strip of self-adherent polymer may be used.--

Column 4, Line 66:

Change "Said polymeric sheet may be adapted for a singular use or" to --Such a polymeric sheet may be adapted for single use or--.

Column 4, Line 67:

Change "alternatively, said sheet may be adapted for a continuous use." to --alternatively, it may be adapted for a continuous use.--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 5, Line 1:

Change "Such a continuous use is provided by means of a fixed or" to --Such continuous use is provided by means of a fixed or--.

Column 5, Line 2:

Change "mobile rolling device. The said roll is adapted to use an" to --mobile rolling device. The roll is adapted to use an--.

Column 5, Line 5:

Change "[schemati-]cally presenting a traditionally handmade bible scroll com-[prising]" to --[schemati-]cally presenting a traditionally hand-made bible scroll com-[prising]--.

Column 5, Line 6:

Change "[com-]prising a first roll (41a) and a second roll (41b). Said rolls" to --[com-]prising a first roller (41a) and a second roller (41b). The rollers--.

Column 5, Line 11:

Change "adjacent to the said bible scroll. Said device comprises of a" to --adjacent to the bible scroll. The device roller comprises a--.

Column 5, Line 13:

Change "sheet (47) is delivered from a first roll (46a) towards a" to --sheet (47) is delivered from a first roller (46a) towards a--.

Column 5, Line 14:

Change "second roll (46b) be means of handle (47), rotated in a 360°" to --second roller (46b) by means of a handle (47), rotated in a 360°--.

Column 5, Line 15:

Change "movement in the direction (48) so the transparent sheet is" to --movement in the direction (48) so that the transparent--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 5, Line 16:

Change "moving downwards (49). To align the insertion printed on" to --moves downwards (49). Alignment of the insertion printed on--.

Column 5, Line 17:

Change "sheet (47) with the biblical text (44) is easily provided by" to --sheet (47) with the biblical text (44) is facilitated by--.

Column 5, Line 18:

Change "means dashed line (47a) indicating the place of the" to --means of a dashed line (47a) indicating the proper piece--.

Column 5, Line 20:

Change "Subesquently reference is showing made now to FIG. 5, presenting" to --Reference is made now to FIG. 5, presenting--.

Column 5, Line 21:

Change "the very same roller, whereat the text was rolled to a certain" to --alignment of the same roller, showing the text rolled to a certain--.

Column 5, Line 22:

Change "page, and further wherein the cantillation marks are pro-[jected]" to --page, and further showing the cantillation marks pro-[jected]--.

Column 5, Line 23:

Change "[pro-]jected on top of the text of the said page." to --[pro-]jected on top of the text of the page--.

Column 5, Line 26:

Change "other signs as defined in the present invention, said device" to --other signs as defined in the present invention, the device--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 5, Line 27:

Change "comprises of a relatively rigid frame (61) accomodating a" to --comprising a relatively rigid frame (61) accomodating a--.

Column 5, Line 28:

Change "transparent sheet (62) whereat said cantillation and/or signs" to --transparent sheet (62) on which cantillation and/or signs--.

Column 5, Line 29:

Change "are written or printed (63). According to one embodiments" to --are written or printed (63). According to one embodiment--.

Column 5, Line 31:

Change "said frame so that the device is suitable to be appended upon the" to --the frame so that the device is suitable to be appended upon the--.

Column 5, Line 32:

Change "printed matter at any position. Said embodiment is espe-[cially]" to --printed matter at any position. Such an embodiment is espe-[cially]--.

Column 5, Line 33:

Change "[espe-]cially useful to be used in that torah scroll that is to be open" to --[espe-]cially useful for a Torah scroll that is--.

Column 5, Line 34:

Change "to be read in a perpendicular orientation." to --read in an upright orientation.--.

Column 5, Line 35:

Change "Reference is still made to FIG. 6B schematically present-[ing]" to --Reference is also made to FIG. 6B schematically present-[ing]--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 5, Line 40:

Change “a mutual holder (65). Each of said sheets contains signs or” to --a mutual holder (65). Each of the sheets contains signs or--.

Column 5, Line 41:

Change “cantillation to be projected over a subsequent page of the” to --cantillation marks to be projected over a subsequent page of the--.

Column 5, Line 42:

Change “printed matter and/or torah scroll.” to --printed matter and/or Torah scroll--.

Column 5, Line 44:

Change “[present-]ing a simplified block diagram of a method for projecting” to --[present-]ing a simplified flow diagram of a method for projecting--.

Column 5, Line 46:

Change “matter, as such as a traditional handmade biblical scroll. Said” to --matter, as such as a traditional handmade biblical scroll. The--.

Column 5, Line 48:

Change “to a file. It is acknowledged that in many cases, expensive” to --to a file. It should be noted that in many cases, expensive--.

Column 5, Line 52:

Change “or in parallel, said cantillation marks of the original text is” to --or in the parallel, the cantillation marks of the original text are--.

Column 5, Line 56:

Change “to said characters are provided and subsequently compared” to --to the characters are provided and subsequently compared--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 5, Line 59:

Change "(76). In case the mark is not fitting the character, a mistake" to --(76). In case the mark does not fit the character, a mistake--.

Column 5, Line 60:

Change "announcement is to be presented (77). If the user is allowing" to --message is presented (77). If the user allows--.

Column 5, Line 61:

Change "the correlation, the very same overlapping is provided (78)." to --the correlation, the same overlapping is proved (78)--.

Column 5, Line 63:

Change "stopped (79). The character is to be fitted with the cantilla-[tion]" to --stopped (79). The character is fitted witht hte cantilla-[tion]--.

Column 5, Line 66:

Change "continue until the end of the text (82) or the next page is been" to --continued until the end of the text (82) or the next page is--.

Column 6, Line 3:

Change "other know techniques, such as photocopying the printed" to --other known techniques, such as photocopying the printed--.

Column 6, line 7:

Change "the positioning of the signs are preparing a media for" to --the positioning of the signs for preparing a medium for--.

Column 6, Line 11:

Change "comprising; (a) scanning a sheet printed with characters" to --comprises: (a scanning a sheet printed with characters--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 6, Line 12:

Change "each of which is having a predetermined X-Y coordination" to --each of which has predetermined X-Y coordinates--.

Column 6, Line 14:

Change "[char-]acters by means of appropriate computer program; (c)" to --[char-]acters by means of an appropriate computer program; (c)--.

Column 6, Line 15:

Change "registering the X-Y coordination of each character or of" to --registering the X-Y coordinates of each character or of--.

Column 6, Line 19 -20:

Change "appropriate X-Y coordination respective to the corresponding character (or characters) (f) preparing a media of signs" to --appropriate X-Y coordinates relative to the corresponding character (or characters) (f) preparing a medium of signs--.

Column 6, Line 31:

Change "verifies each character versus similar character existing in a" to --verifies each character versus a similar character existing in a--.

Column 6, Line 33:

Change "believed to be exactly correspond, wherein at least a part of" to --believed to be exactly correspond, wherein at least some of--.

Column 6, Line 36:

Change "in the scanned file as matching a versus character in the" to --in the scanned file as matching a character in the--.

Column 6, Line 38:

Change "comparison file is being copied to a new file that contains" to --comparison file is copied to a new file that contains--.

UNITED STATES PATENT AND TRADEMARK OFFICE

CERTIFICATE OF CORRECTION

PATENT NO. : 7,236,144 B2
APPLICATION NO. : 10/749568
DATED : June 26, 2007
INVENTOR(S) : Amichai Ben Ari It is certified that error appears in the above-identified patent and that said Letters Patent is hereby corrected as shown below:

Column 6, Line 40:

Change "predetermined manner respective to the X-Y coordination of" to --predetermined manner respective to the X-Y coordinates of--.

Signed and Sealed this

Third Day of June, 2008

JON W. DUDAS
*Director of the United States Patent and Trademark Office*